US009995547B2

(12) United States Patent
Bandini et al.

(10) Patent No.: US 9,995,547 B2
(45) Date of Patent: Jun. 12, 2018

(54) DOUBLE-BARRELLED GUN AND TWO-ROW MAGAZINE

(75) Inventors: Nicola Bandini, Siena (IT); Dimitry Streshinskiy, Paris (FR)

(73) Assignee: ARSENAL FIREARMS FINANCE LIMITED, Road Town, Tortola (VG)

( * ) Notice: Subject to any disclaimer, the term of this patent is extended or adjusted under 35 U.S.C. 154(b) by 206 days.

(21) Appl. No.: 13/510,795

(22) PCT Filed: Apr. 16, 2012

(86) PCT No.: PCT/IB2012/051887
§ 371 (c)(1),
(2), (4) Date: May 18, 2012

(87) PCT Pub. No.: WO2012/156835
PCT Pub. Date: Nov. 22, 2012

(65) Prior Publication Data

US 2012/0291324 A1 Nov. 22, 2012

(30) Foreign Application Priority Data

May 19, 2011 (IT) ..... BS2011A0071

(51) Int. Cl.

| | |
|---|---|
| ***F41A 3/00*** | (2006.01) |
| ***F41A 9/63*** | (2006.01) |
| ***F41A 5/04*** | (2006.01) |
| ***F41A 9/68*** | (2006.01) |
| ***F41A 19/18*** | (2006.01) |
| ***F41C 3/00*** | (2006.01) |
| ***F41F 1/08*** | (2006.01) |

(52) U.S. Cl.
CPC ..... *F41A 9/63* (2013.01); *F41A 5/04* (2013.01); *F41A 9/68* (2013.01); *F41A 19/183* (2013.01); *F41C 3/00* (2013.01); *F41F 1/08* (2013.01)

(58) Field of Classification Search
CPC ..... F41A 9/63; F41A 9/68; F41A 5/04; F41A 19/183; F41A 1/06; F41A 21/08; F41C 3/00; F41F 21/08
USPC ..... 42/14
See application file for complete search history.

(56) References Cited

U.S. PATENT DOCUMENTS 943,819 A 12/1909 Du Bose
984,519 A 2/1911 Browning
(Continued)

FOREIGN PATENT DOCUMENTS

DE 102005028603 A1 12/2006
GB 2457992 A 9/2009

OTHER PUBLICATIONS

European Office Action dated Jul. 24, 2012 in corresponding EP Application No. 12166099.7.

*Primary Examiner* — Michelle R Clement
(74) *Attorney, Agent, or Firm* — Harness, Dickey & Pierce, P.L.C.

(57) ABSTRACT

The present invention relates to a gun (1) with a pair of barrels (6', 6") flanking each other, each delimiting a cartridge chamber (12', 12").

The gun further comprises a pair of firing pin tips (8', 8") for a cartridge (10', 10"), movable towards the cartridge chambers (12', 12") by means of a firing device operated by a trigger (4', 4"); such device acts on the firing pin tips to allow a substantially simultaneous advancement thereof.

The invention also relates to a two row magazine for a double barrelled gun.

15 Claims, 17 Drawing Sheets

(56) References Cited

U.S. PATENT DOCUMENTS 1,202,707 A * 10/1916 Grieco ..... F41A 9/69 42/7
1,772,227 A * 8/1930 Revelli ..... F41A 11/04 42/13
1,839,621 A 1/1932 Onorati
2,041,015 A * 5/1936 Onorati ..... F41A 19/21 42/17
2,577,335 A * 12/1951 Lambert ..... F41A 3/58 42/12
2,935,915 A * 5/1960 Janson ..... F41A 5/28 89/126
3,260,009 A * 7/1966 Hillberg ..... F41A 19/23 42/41
3,431,853 A * 3/1969 Allen ..... F41A 19/23 102/370
3,651,594 A * 3/1972 Hillberg ..... F41A 21/08 42/76.01
3,942,279 A * 3/1976 Ruger ..... F41A 21/08 42/76.01
4,228,605 A * 10/1980 Chacornac ..... F41A 21/08 42/106
4,285,153 A * 8/1981 Crouch ..... F41A 19/58 102/202.5
4,400,900 A * 8/1983 Hillberg ..... F41A 19/14 42/42.03
4,400,901 A * 8/1983 Hillberg ..... F41A 17/74 42/70.08
4,407,085 A * 10/1983 Hillberg ..... F41A 19/53 42/69.01
4,867,039 A * 9/1989 Dobbins ..... F41A 9/35 42/18
4,967,642 A * 11/1990 Mihaita ..... F41A 3/72 89/126
4,989,359 A * 2/1991 Kinkner ..... F41A 21/06 42/77
5,870,846 A * 2/1999 Ledford ..... F41C 7/02 42/75.01
6,557,449 B1 * 5/2003 O'Dwyer ..... F41A 21/06 89/1.41
6,668,479 B1 12/2003 Obong
6,935,063 B1 * 8/2005 Johnson ..... F41A 1/08 42/40
7,971,380 B1 * 7/2011 Gussalli Beretta ..... F41A 15/06 42/46
8,281,512 B2 * 10/2012 Lara ..... F41C 27/00 224/198
8,296,987 B1 * 10/2012 Dlubak ..... F41A 21/08 42/75.01
8,915,174 B1 * 12/2014 Heizer ..... F41A 21/06 89/14.3
8,950,311 B2 * 2/2015 Emde ..... F41C 3/00 89/1.41
9,115,954 B1 * 8/2015 Corsi ..... F41C 7/02
2001/0045044 A1 * 11/2001 Kroll ..... F41A 11/02 42/16
2006/0162217 A1 * 7/2006 Longueira ..... F41A 19/15 42/16
2006/0185508 A1 * 8/2006 Curry ..... F41A 25/22 89/196
2007/0151438 A1 7/2007 Courty
2011/0072704 A1 * 3/2011 Teach, Jr. ..... F41A 3/58 42/8
2011/0107645 A1 5/2011 Faifer
2012/0227577 A1 * 9/2012 Dillon ..... F41A 21/08 89/12
2012/0291324 A1 * 11/2012 Bandini ..... F41A 5/04 42/14
2013/0145666 A1 * 6/2013 Eriksson ..... F41G 1/30 42/1.06
2013/0174462 A1 * 7/2013 Moretti ..... F41A 21/08 42/76.1
2014/0165441 A1 * 6/2014 Emde ..... F41C 3/00 42/8
2015/0184957 A1 * 7/2015 Guerini ..... F41A 3/06 42/40
2015/0253097 A1 * 9/2015 Kohout ..... F41A 19/21 42/8
2016/0153744 A1 * 6/2016 Teetzel ..... F41C 27/06 42/105

* cited by examiner

DOUBLE-BARRELLED GUN AND TWO-ROW MAGAZINE

CROSS-REFERENCE TO RELATED APPLICATIONS

This application is a 371 U.S. National Stage of International Application No. PCT/1132012/051887, filed Apr. 16, 2012, and claims priority to Italian patent application No. BS2011A000071, filed May 19, 2011, the disclosures of which are herein incorporated by reference in their entirety.

FIELD OF INVENTION

The present invention relates to a double barrelled gun and a magazine which can be used with a double barrelled gun.

DESCRIPTION OF THE PRIOR ART

The use of guns with two barrels flanking each other wherein, by means of a special selector, the barrel suitable for firing a bullet is determined, is known of for example from document U.S. Pat. No. 1,202,707 A.

Such guns use the cartridges from a first magazine until exhausted, after which they switch automatically to receive a supply from a second magazine flanking the first.

However there are applications, for example in the armaments field or for training purposes, in which the need is increasingly felt to be able fire two types of cartridge (such as a tracking bullet and an ordinary bullet) at the same time.

Such need must however occur in the absence of a double firing action: in the presence of such effect it would in fact be extremely difficult to guarantee the precision of the second bullet coming out of the barrels, mainly on account of the recoil of the first detonation.

SUMMARY OF THE INVENTION

The present invention therefore sets out, in the aforesaid context, to supply a gun suitable for firing two bullets from barrels flanking each other in a substantially simultaneous manner, and where the double firing action is virtually absent.

Such objective is achieved by a gun comprising a gripping portion and at least one trigger mounted in a movable manner to the gripping portion, a first and a second barrel, connected to the gripping portion and flanking each other, wherein an end portion of each barrel delimits a cartridge chamber, and a first and a second firing pin tip for a cartridge, movable towards the cartridge chambers by means of a firing device operated by the trigger, wherein the firing device acts on the firing pin tips to allow a substantially simultaneous advancement thereof. The dependent claims show preferred embodiment variations.

BRIEF DESCRIPTION OF THE DRAWINGS

The present invention will now be described in detail, with the help of the attached drawings, wherein.

DESCRIPTION OF THE PREFERRED EMBODIMENT

Figure 1:
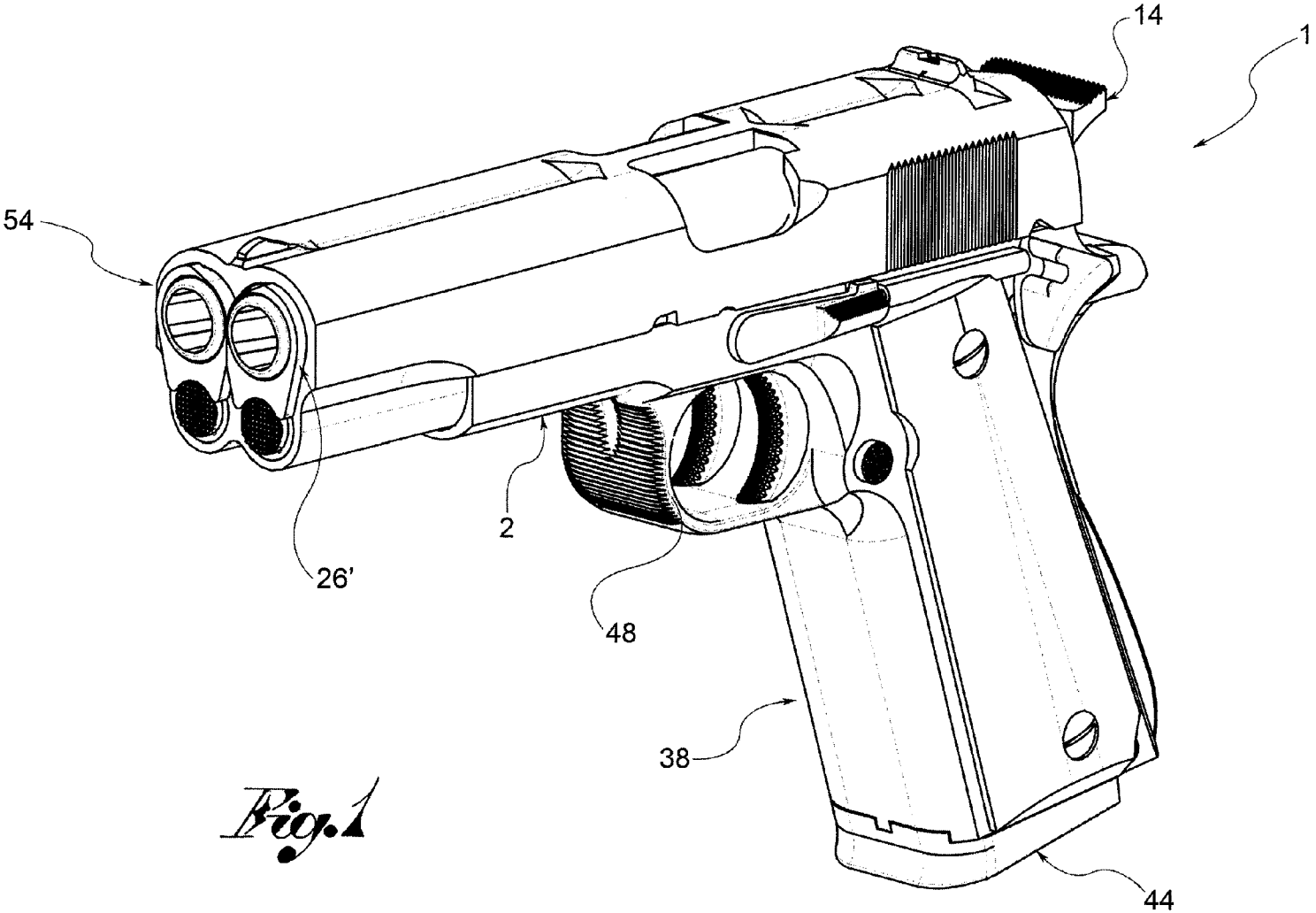
FIGS. 1, 2 and 3 respectively show a front perspective, rear and front view of a gun of the present invention, according to a possible embodiment.
Figure 2:
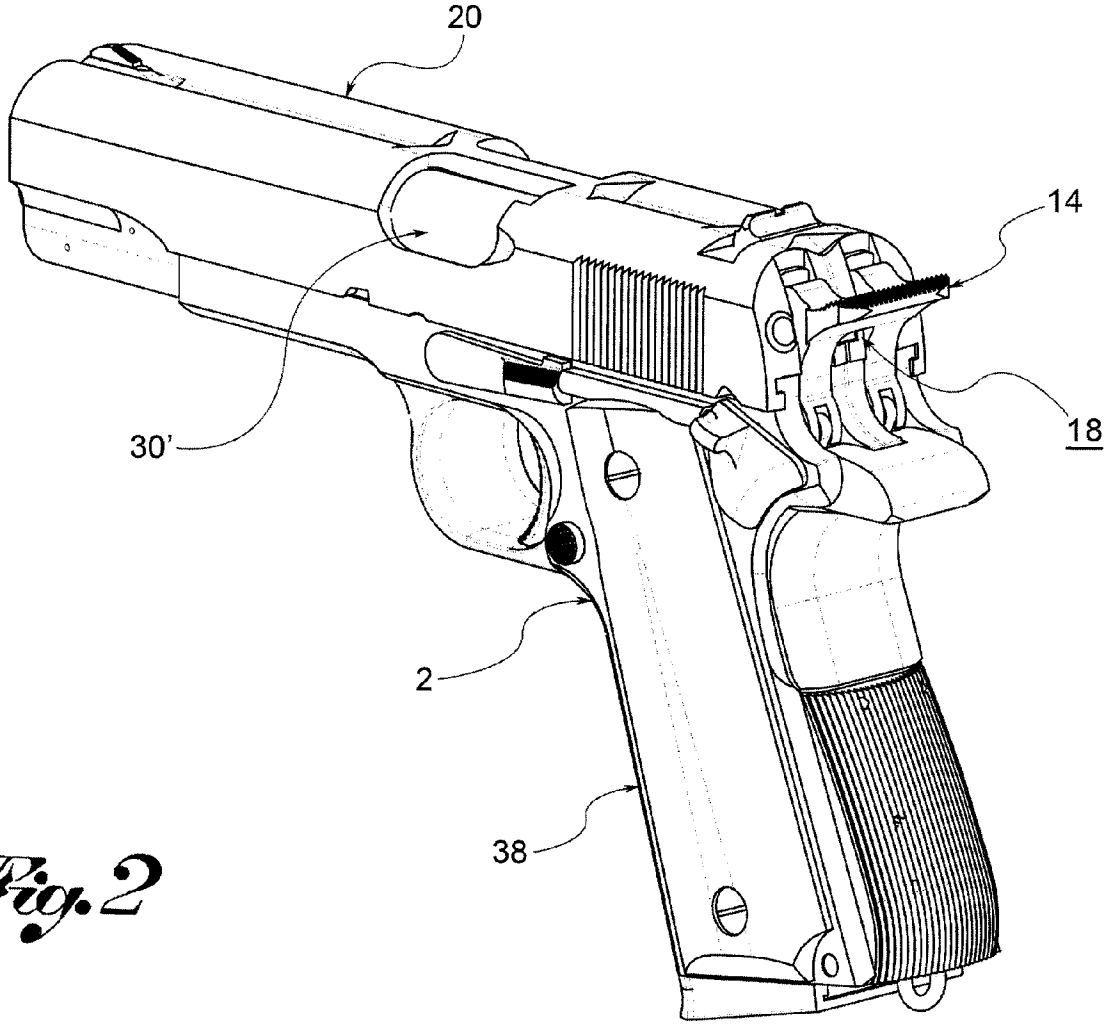
Figure 3:
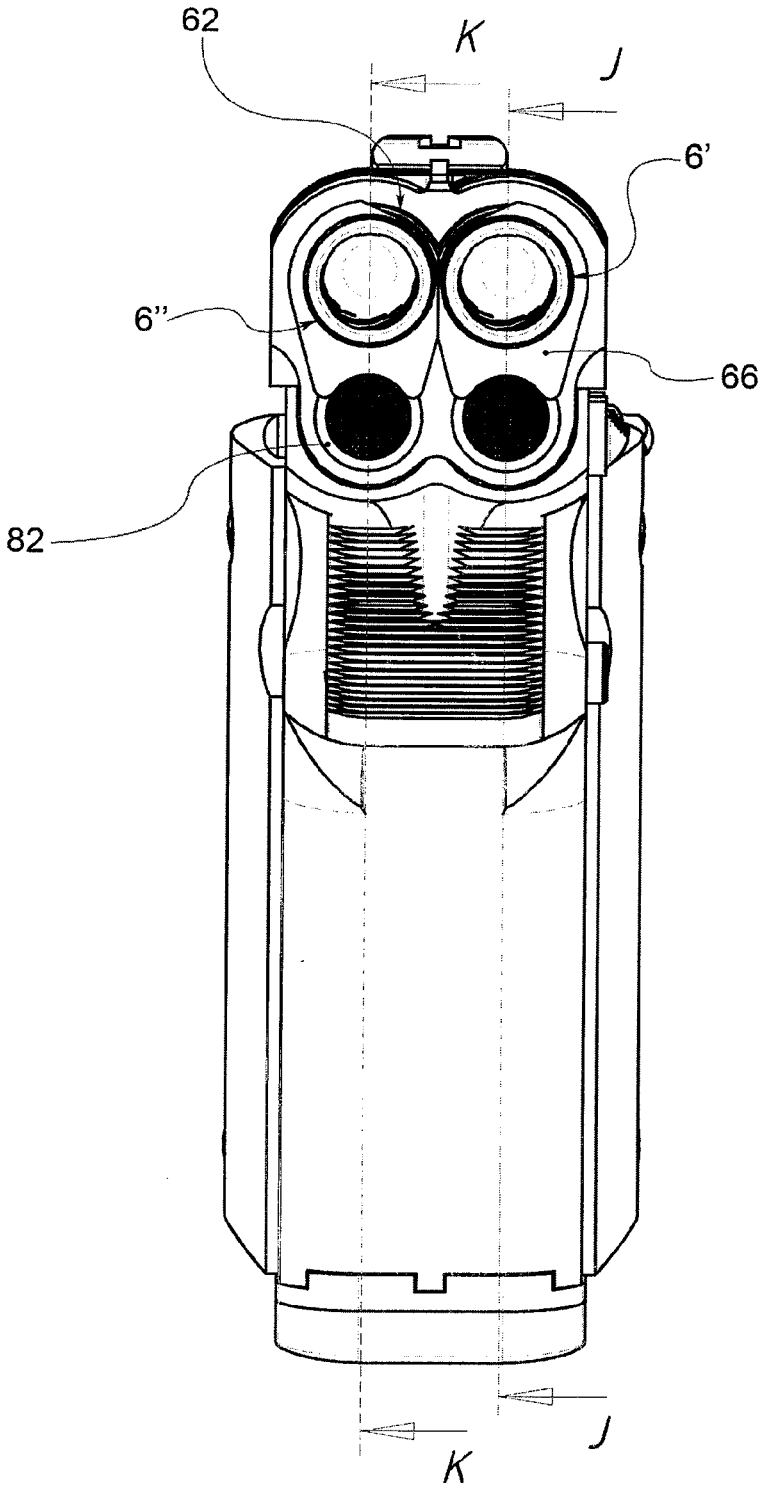
Figure 4:
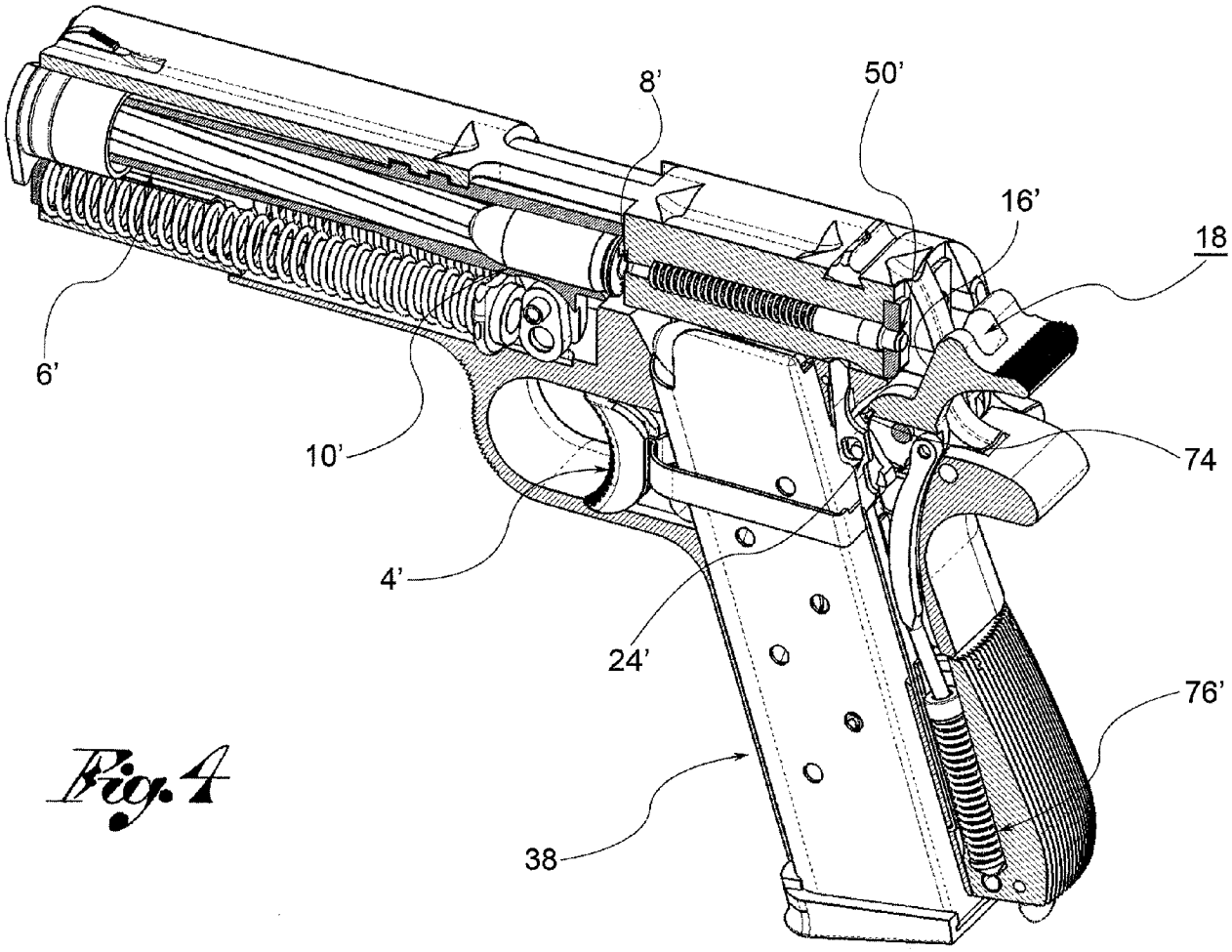
FIGS. 4 and 5 show two longitudinal cross-sections respectively along the planes J and K of FIG. 3.
Figure 5:
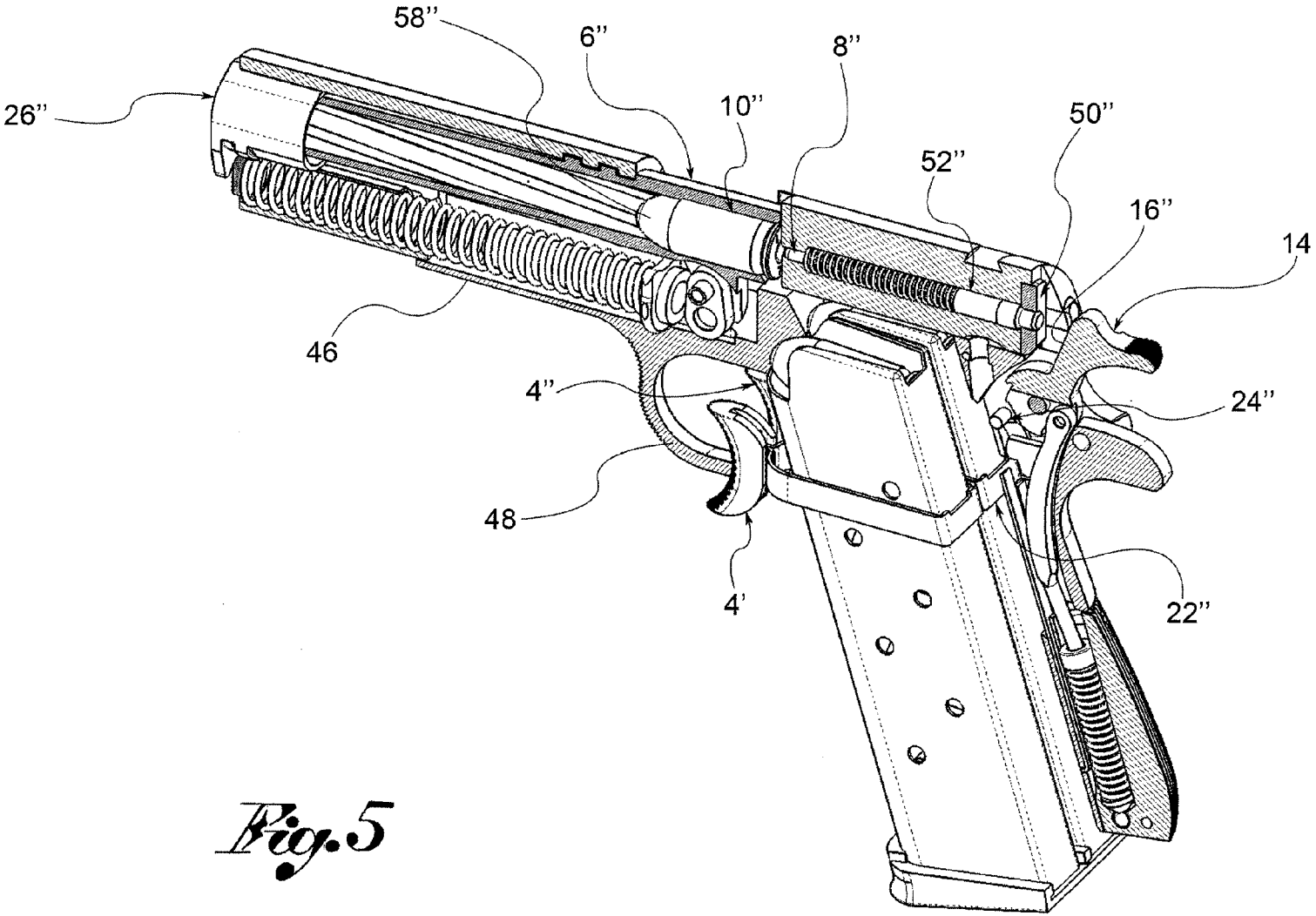
Figure 6:
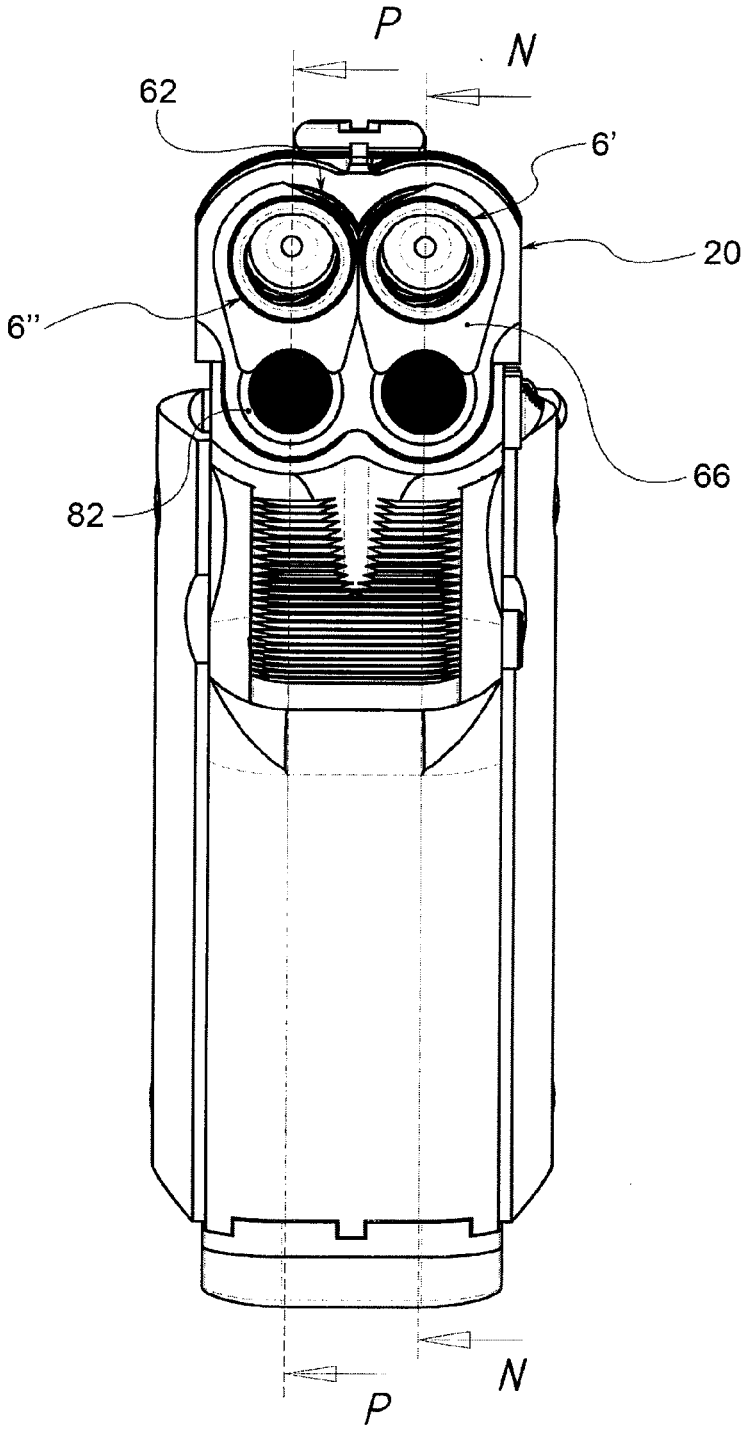
FIGS. 6, 9 and 12 show front views corresponding to FIG. 3, but in different functioning configurations of the gun.
Figure 7:
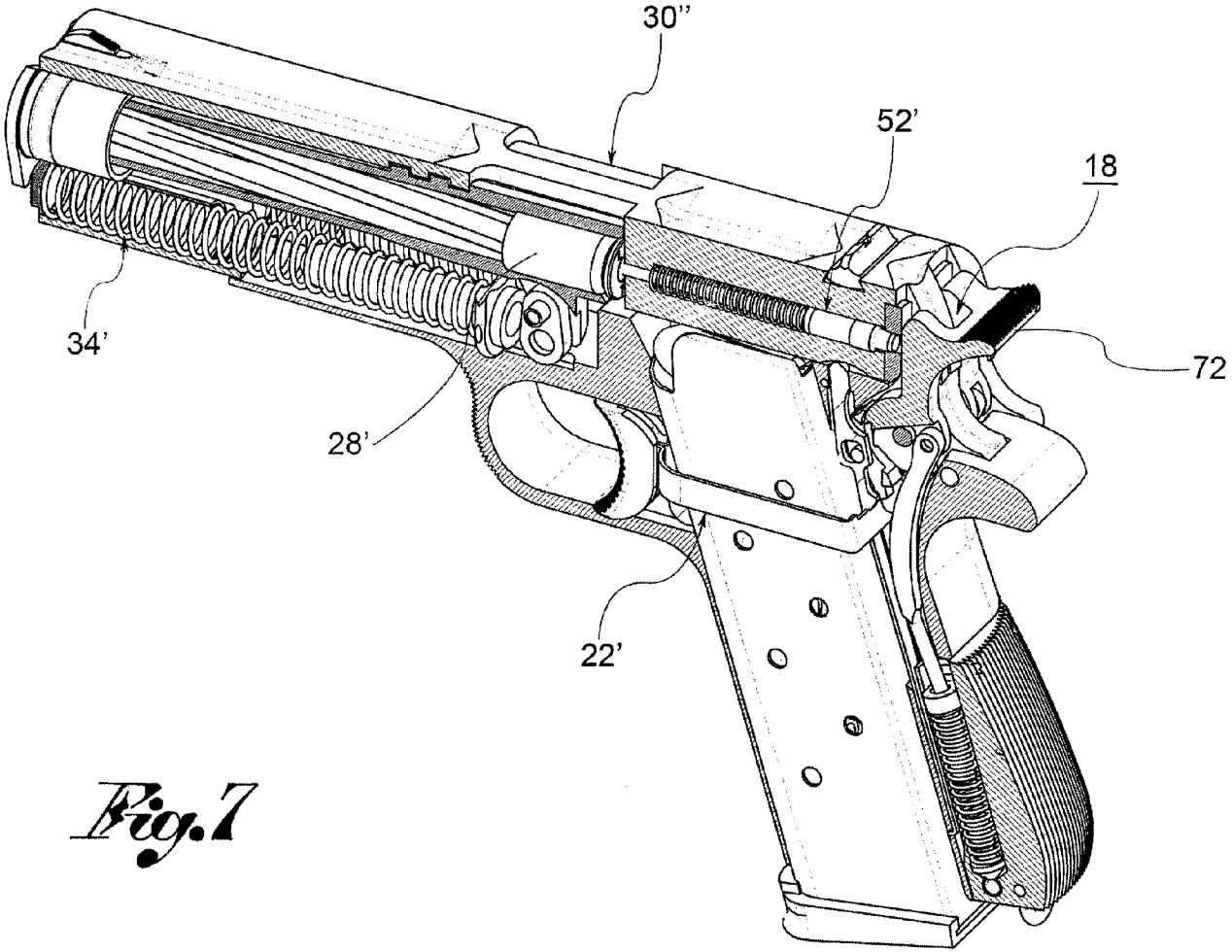
FIGS. 7 and 8, 10 and 11, 13 and 14 show longitudinal cross-sections respectively at the planes P and N, R and Q, T and S of FIGS. 6, 9 and 12.
Figure 8:
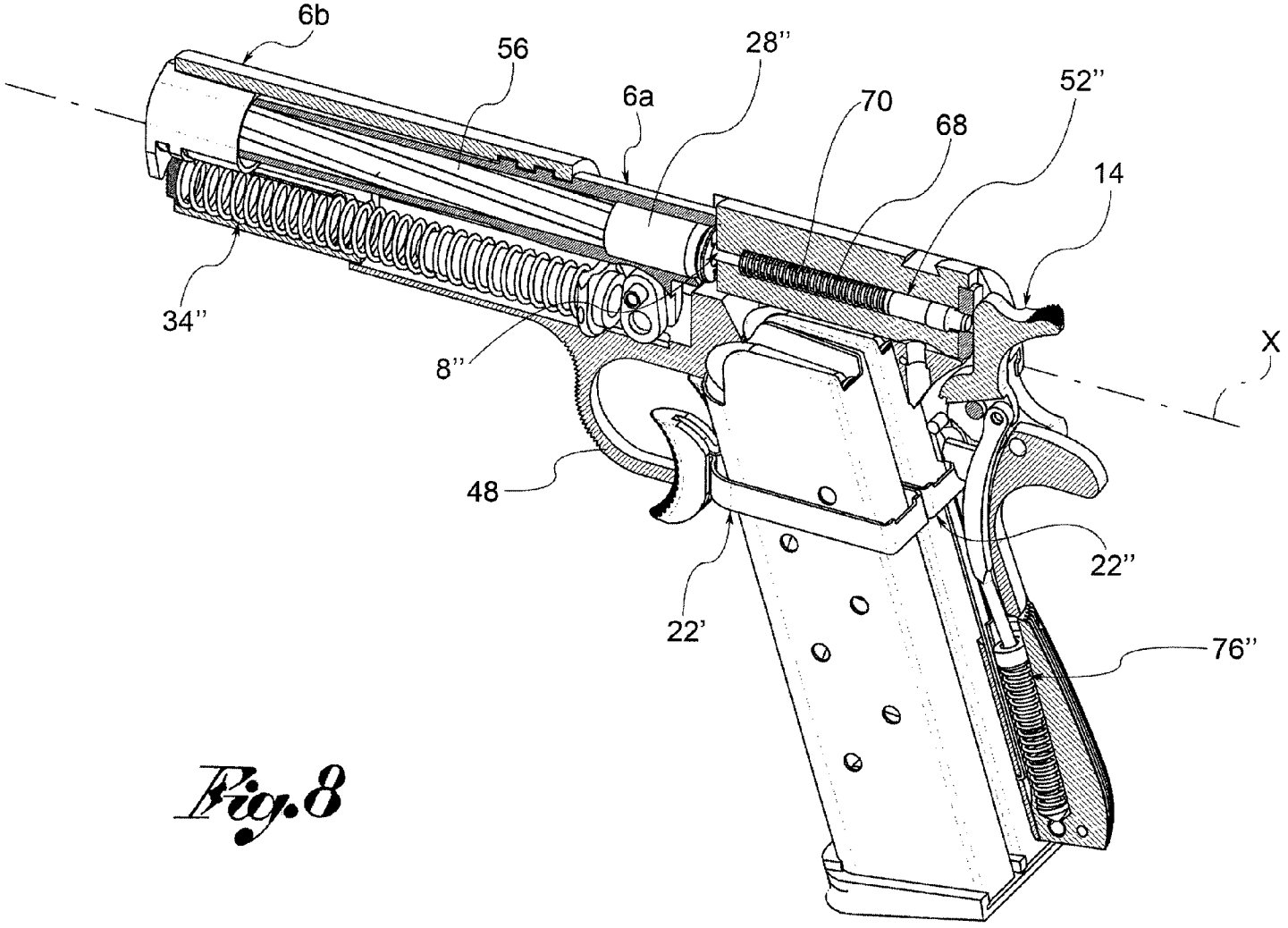

With reference to the aforesaid drawings, reference numeral 1 globally denotes a gun.

Preferably, the gun which the present invention relates to is semi-automatic or automatic, optionally switchable from the semi-automatic to automatic mode by means of a special function selector (not shown).

Such gun 1 comprises a gripping portion 2 and at least one trigger 4', 4" mounted in a movable manner to the gripping portion 2.

In particular, the trigger 4', 4" is mounted in a translatable (as shown in the figures) or rotatable manner in relation the gripping portion 2.

The gripping portion 2 advantageously comprises a grip or grippable part 38, preferably ergonomically shaped in relation to a user's hand.

According to one embodiment, the gripping portion 2 further comprises a support wall 46, connected to the grippable part 38 and which extends from it along a barrel direction X.

According to a further embodiment, the gripping portion 2 comprises a trigger guard 48 which extends from the support wall 46 to the grippable part 38, advantageously made in one piece with the aforesaid wall 46 and the aforementioned part 38.

According to yet a further embodiment, the grippable part 38 is hollow so as to reversibly receive a magazine, for example two-rowed.

Preferably, the gun comprises a two row magazine 36 engaged in the aforesaid grippable part 38.

Advantageously, such magazine 36 comprises a pair of reciprocally separate and parallel rows 40', 40", each delimiting a compartment 42', 42" to slidingly house a plurality of cartridges 10', 10" and a magazine bottom 44 connected to the rows 40', 40" to join them to each other.

So, each of the rows 40', 40" has an access aperture to the respective housing compartments 42', 42", so that the cartridges 10', 10" are fed in a parallel manner to the cartridge chambers described below from different rows. For example, such supply occurs by means of springs (not shown) which push the cartridges from the bottom of the row towards the access apertures.

According to a preferred variant, the connection of at least one 40', 40" of said rows to the bottom of the magazine 44 is releasable, for example by means of a dovetail coupling. Advantageously, both the rows have such releasable coupling.

The gun further comprises a first 6' and a second 6" barrel, connected to the gripping portion 2 and flanking each other, wherein an end portion of each barrel 6', 6" delimits a cartridge chamber 12', 12".

As a result, the cartridge chambers 12', 12", preferably positioned at proximal end portions 6*a* of the barrels 6', 6", are suitable for receiving at least partially respective cartridges 10', 10"

Within this patent text, the term "proximal" will be taken to mean the components of the gun positioned near or towards the grippable part 38; vice versa, the term "distal" will be used to indicate the components positioned towards a firearm muzzle 54.

According to one variation, the barrels 6', 6" extend parallel to the support wall 46.

According to a further variation, the barrels are of the same calibre, but suitable for receiving munitions of different types. For example, the first barrel 6' can be loaded with a tracking cartridge, and the second barrel 6" with a frangible cartridge, with shot or with ordinary bullets.

According to yet a further variant, the barrels 6', 6" are a different calibre to each other.

In other words, this embodiment makes it possible to select not only the type of cartridge desired, as for example illustrated above, but also the relative calibre.

One advantageous embodiment envisages that the barrels 6', 6" are substantially parallel to each other, for example in the barrel direction X.

According to a further embodiment, the barrels are reciprocally converging in such a way that the bullets 58', 58" coming out of them come closer together at a predefined distance from the gun 1. For example, the barrels can be regulated in such a way that the aforesaid bullets meet 10, 15 or 20 meters from the muzzle 54.

According to one variation, the barrels 6', 6" have the same type of inner rifling 56, so that they both comprise clockwise or anticlockwise riflings.

Preferably, the gun 1 comprises a slide 20 mounted on the barrels 6', 6" in a translatable manner between a rest configuration and an extraction configuration, wherein the slide 20 allows the exit of a cartridge case 28', 28" from at least one of the cartridge chambers 12', 12".

This way, during the translation of the slide 20, for example parallel to the barrel direction X, new cartridges 10', 10" can replace the cartridge cases 28', 28" remaining from the previous firing cycle, as better illustrated below.

According to one variation, the slide 20 is distally supported by the support wall 46.

According to a preferred embodiment, the slide 20 identifies a pair of transit apertures 30', 30", opposite each other, of a sufficient cross-section to expel the cartridge cases 28', 28" from the cartridge chambers 12', 12".

In other words, when the slide 20 moves to the extraction configuration, an extractor claw (not shown), joined to the slide 20 at each barrel, acts in conjunction with the cartridge cases 28', 28" for their expulsion through the transit apertures 30', 30", preferably along substantially symmetrical trajectories.

Preferably, when the slide 20 is in the extraction configuration, the transit apertures 30', 30" communicate with each other forming a passage 32 which extends through the thickness of the gun 1.

Consequently, during the extraction of the gun cases, the complete exit of the gases generated by the firing of the fuse is guaranteed.

Figure 9:
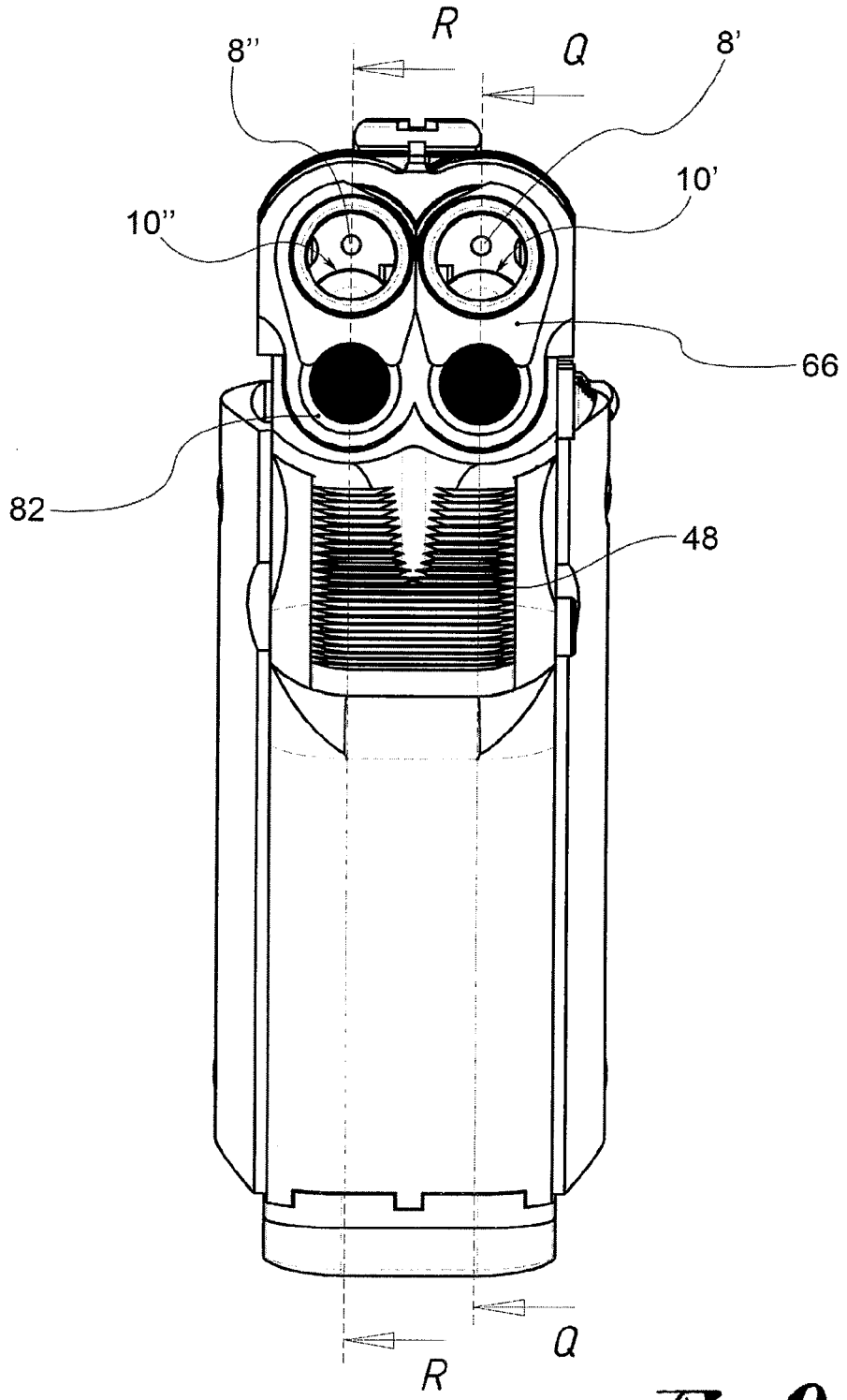
Figure 10:
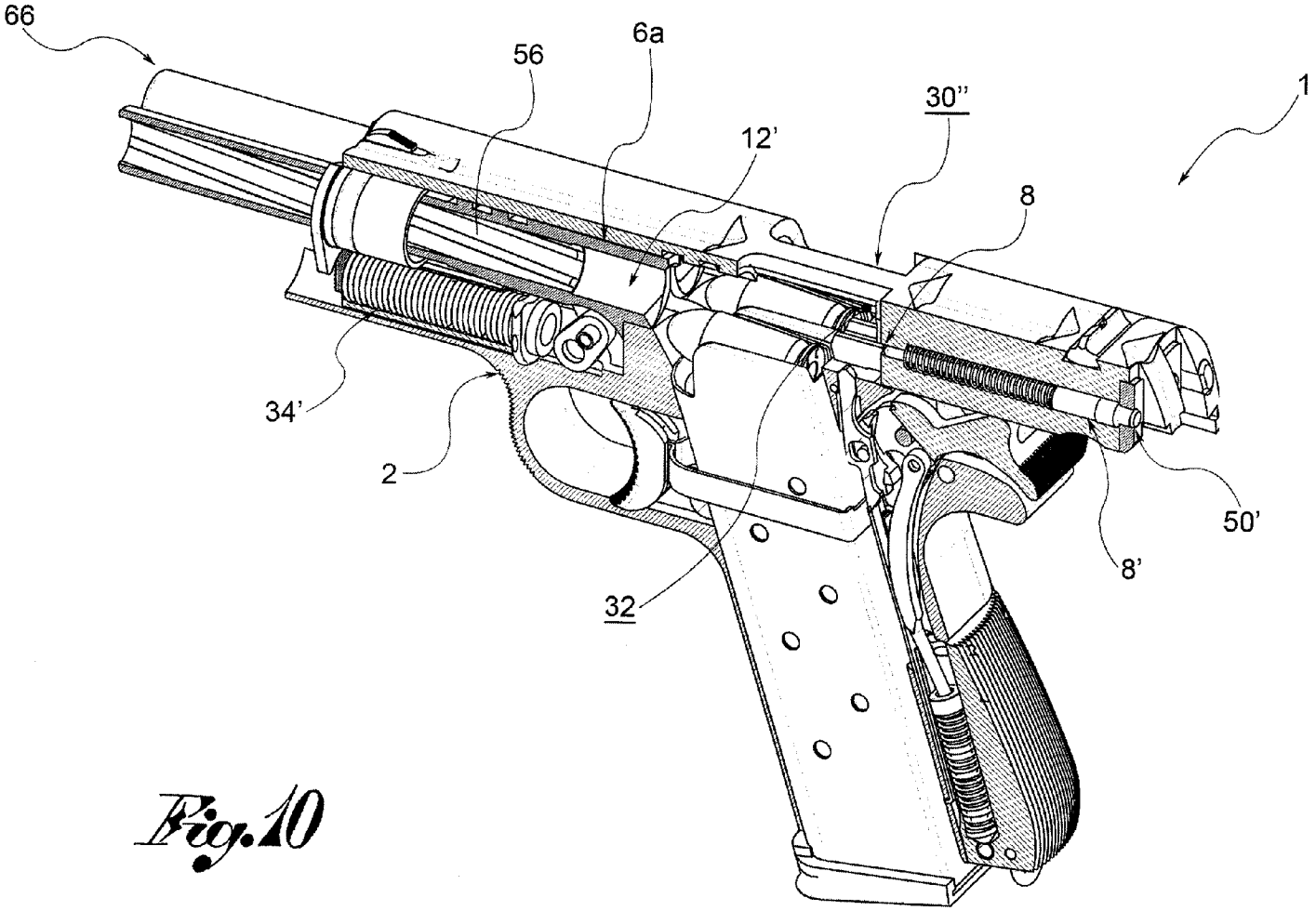
Figure 11:
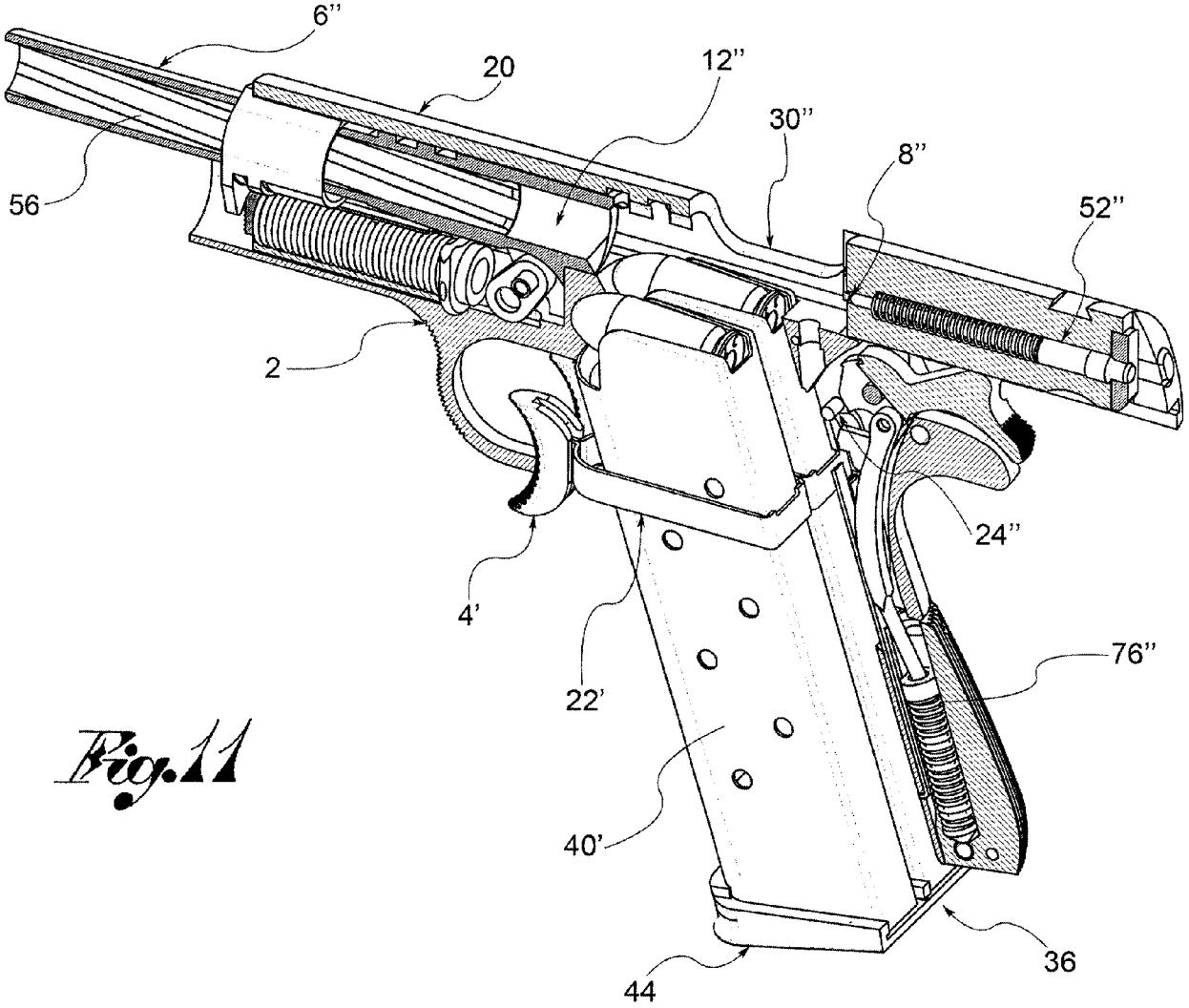
Figure 12:
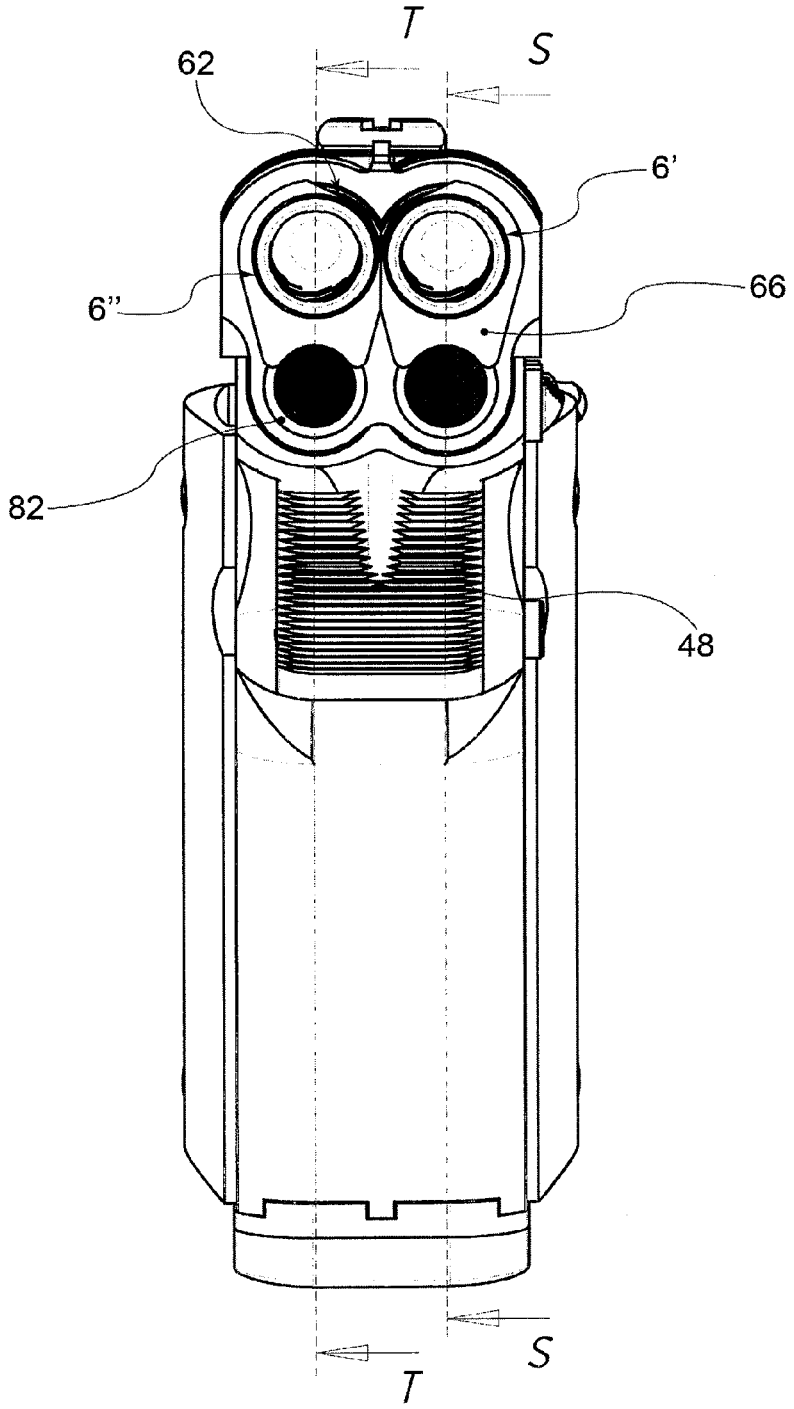
Figure 13:
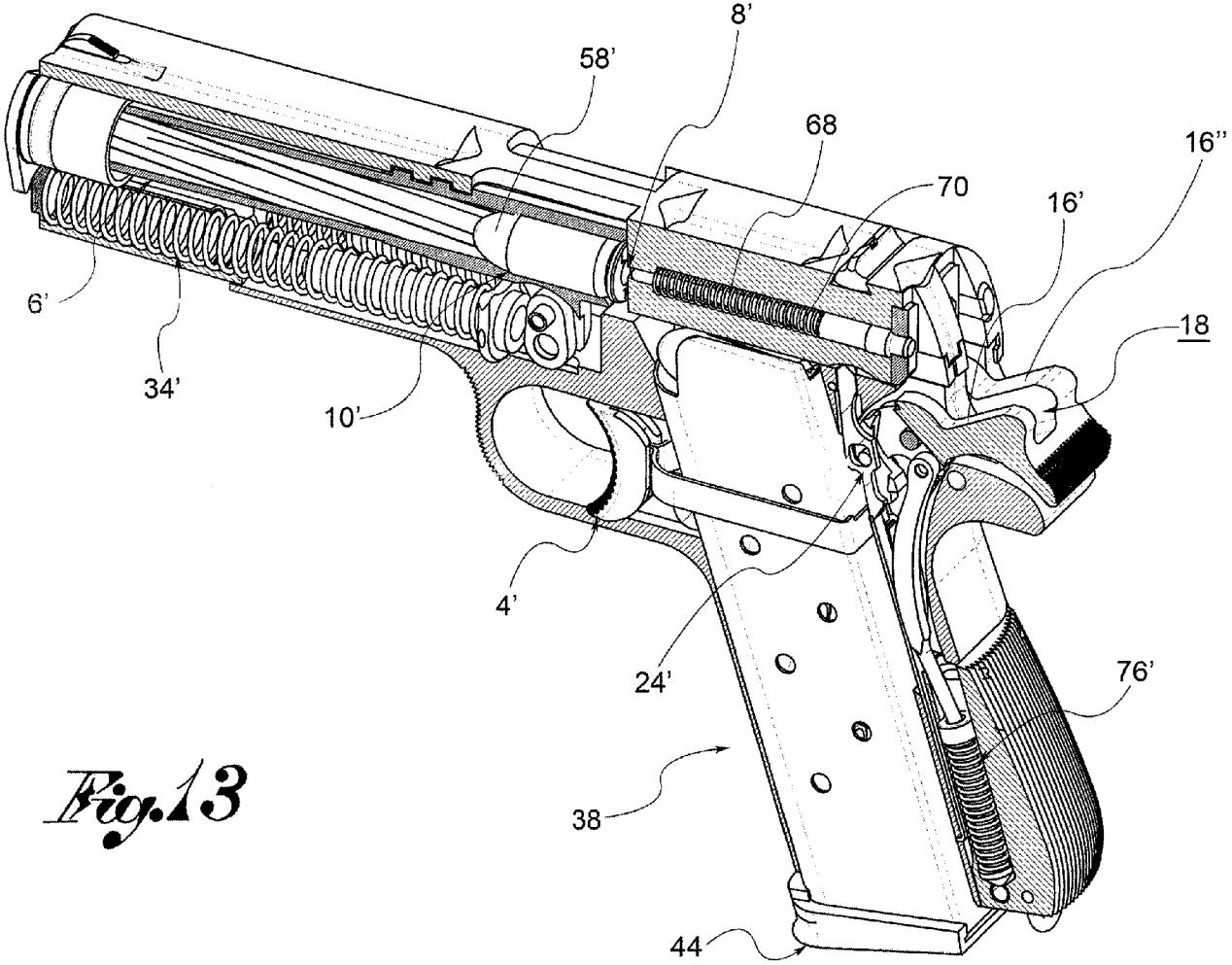
Figure 14:
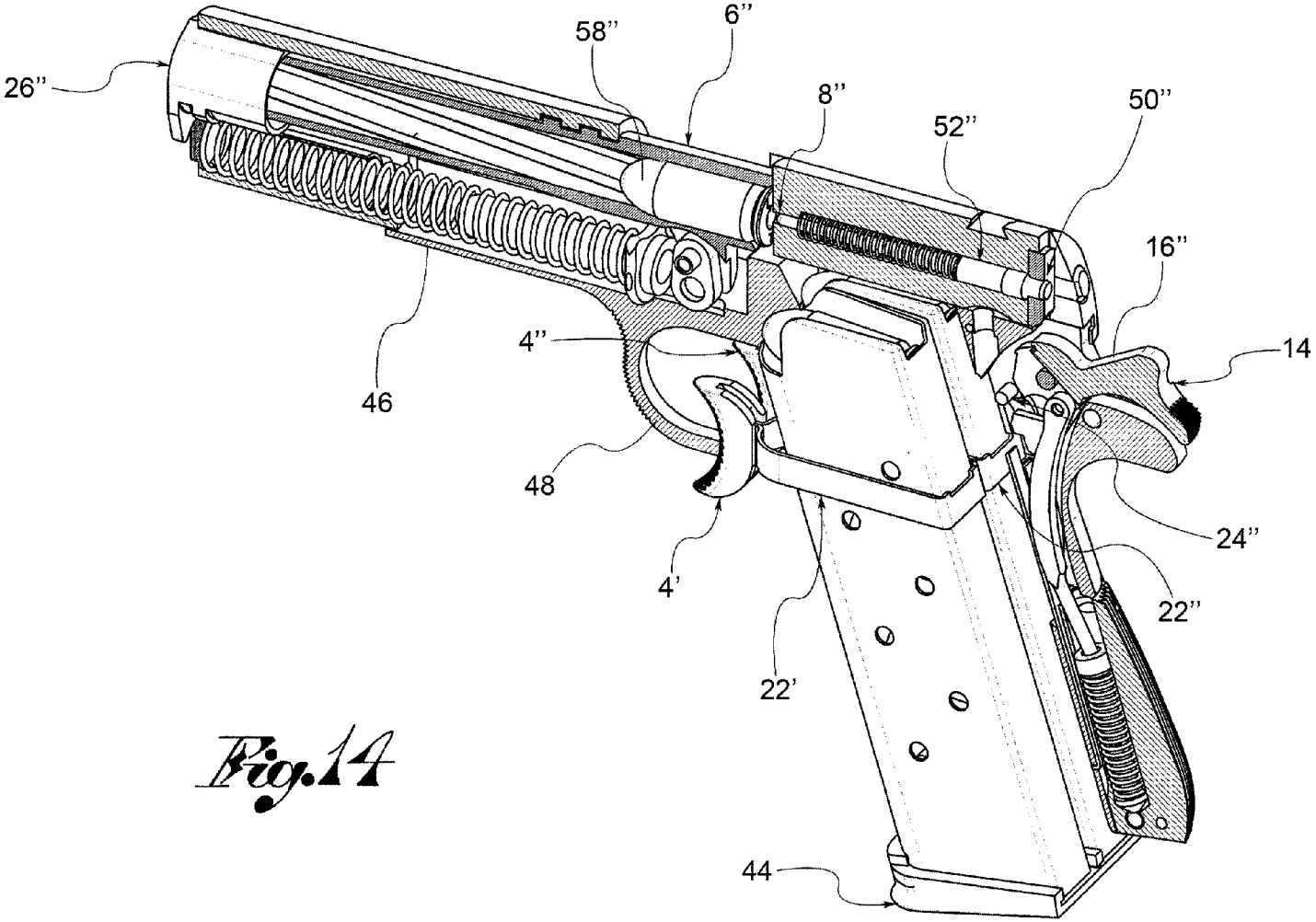

Moreover, when the slide 20 returns to the rest configuration (as shown for example in FIGS. 9 to 11), it interacts preferably with the cartridges 10', 10" surfacing from the magazine 36 for their insertion in the cartridge chambers 12', 12".

According to a particularly advantageous variant, the slide 20 is mounted on the barrels 6', 6" by means of guide bushes 26', 26" which at least partially house said barrels 6', 6", and preferably house a distal end portion 6*b* of such barrels, when the slide 20 is positioned in the rest configuration.

As a result, the guide bushes 26', 26" are positioned between the barrels and the slide in such a way that during the translation of the slide 20 between the aforesaid configurations, such bushes accompany and guide the slide in movement.

Preferably, at least one guide bush 26', 26" has a tubular body 68, which extends around an axis parallel to the barrel axis X and which can be inserted in a distal aperture 60 of the slide 20.

Even more preferably, at least one guide bush comprises a stop element 66, connected to the tubular body 68 and which extends from it in a substantially radial direction.

Advantageously, the stop element 66 is asymmetrical in relation to the extension axis of the bush, that is it protrudes in an uneven manner externally to the outer surface of the guide bush.

In other words, the stop element projects to a greater degree in some circumferential areas of the bush, in relation to the tubular body 68, but to a lesser degree in other areas.

According to a preferred embodiment, the stop element 66 is circumferentially discontinuous, that is the guide bush has a section of bush 62 lacking the stop element, for example wherein the thickness of the element is equal (or even inferior) to the thickness of the wall of the bush or rather the tubular body 68.

Advantageously, the guide bushes 26', 26" are reciprocally counter-rotatable so as to be attached to the slide 20, preferably with a bayonet coupling.

Consequently, according to this variant, after the bushes have been inserted in the distal aperture 60 of the slide 20, they are rotated in reciprocally opposite directions for their attachment.

For the variants which envisage a bayonet coupling, the guide bushes 26', 26" comprise a blocking tooth 64 which extends from the outer surface of each bush and which is suitable to engage a retention groove 66 made in the slide 20.

Figure 15:
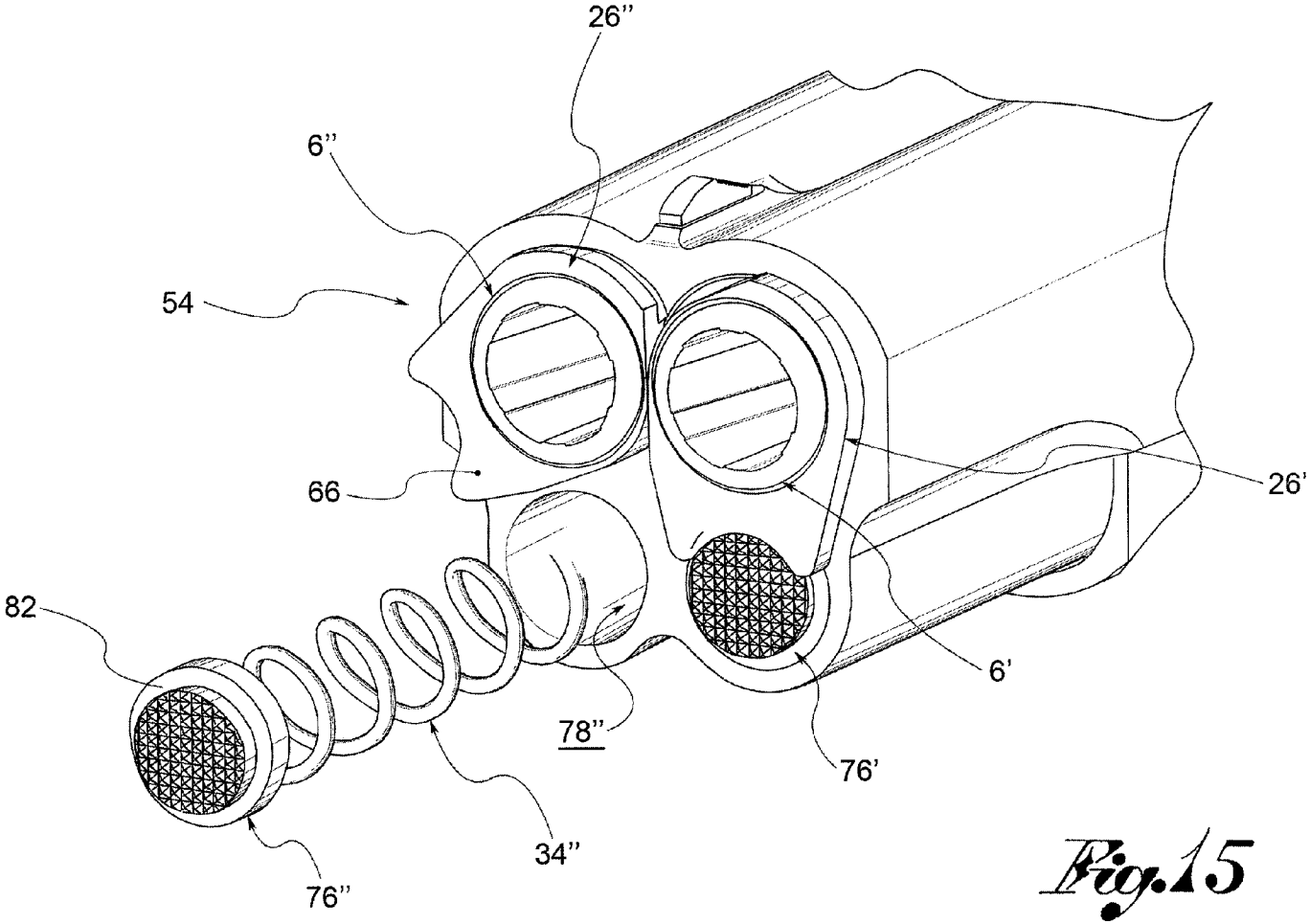
FIGS. 15 and 16 show enlargements of the muzzle of the gun in FIG. 1 respectively in an assembly step of the recovery spring and in the absence of the bushes and of the springs.
Figure 16:
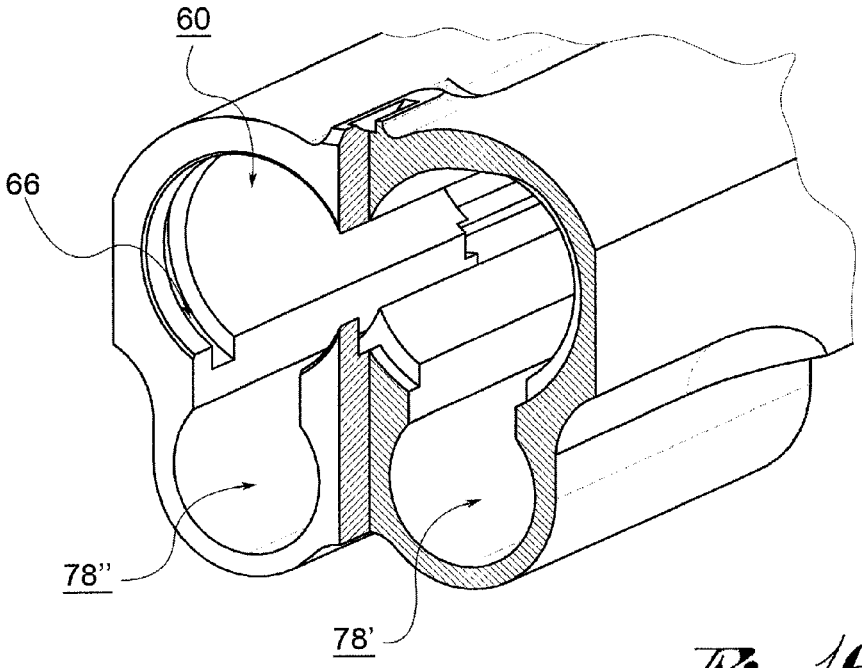
Figure 17:
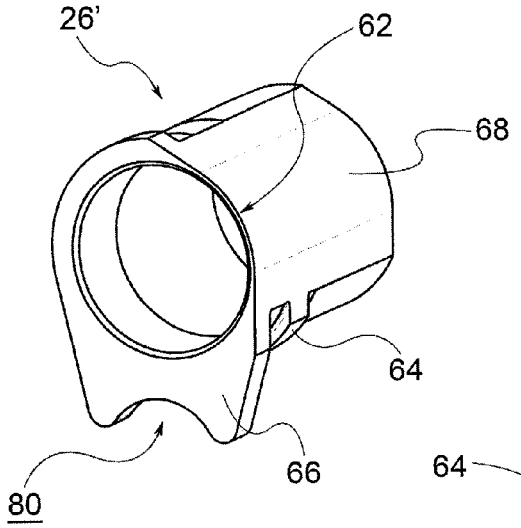
FIGS. 17 and 18 show opposite perspective views of the guide bushes which can be used with the gun which the present invention relates to, according to one possible variant.
Figure 18:
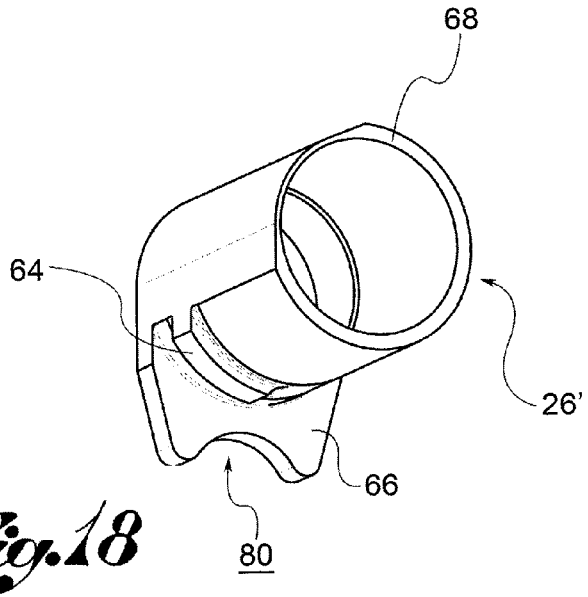
Figure 19:
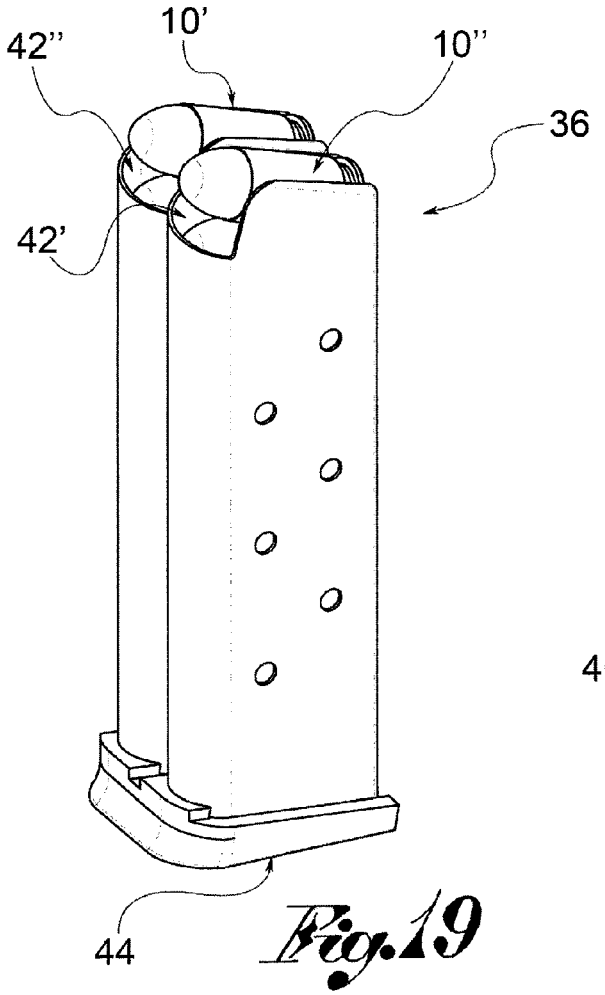
FIGS. 19, 20 and 21 illustrate perspective views of a two row magazine, which the present invention relates to, according to a possible variant, and a magazine bottom used in such magazine.
Figure 20:
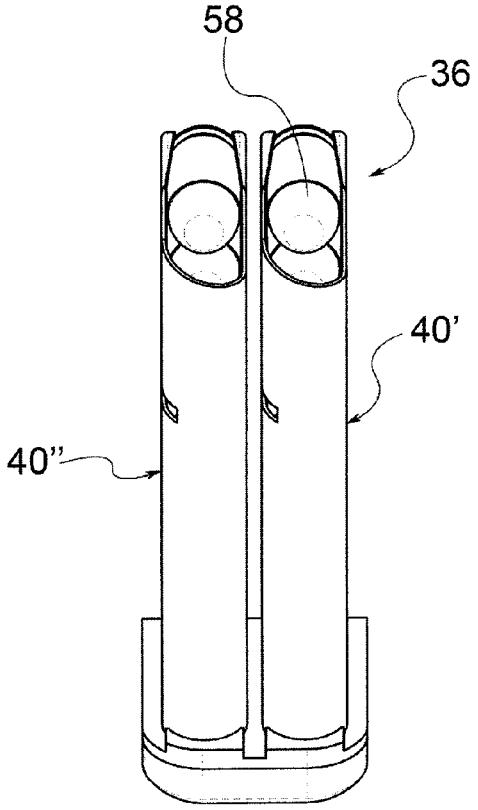
Figure 21:
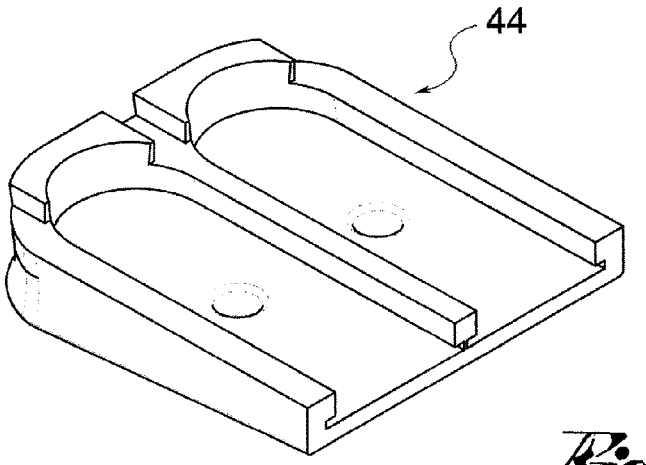

So, the guide bushes are engaged in the distal aperture 60 in a first angular position, wherein the blocking tooth 64 is free of impediments for an axial engagement with the slide 20. Such configuration is, for example shown for the bush 6" in FIG. 15. Subsequently, when the blocking tooth 64 is rotationally aligned to a mouth of the retention groove 66, the bush-slide attachment is completed by performing a rotation, in an anticlockwise direction in the variant shown.

As regards the assembly of the first bush 6', the assembly steps are the same, except for the final rotation, which is clockwise.

Should the space available between the guide bushes be limited, for example in the case in which the barrels are mounted very close on the gripping portion, it is particularly advantageous to envisage a section of bush 62 lacking the stop element 66; in fact, such variant permits a reduction of the transversal dimensions (thickness) of the firearm, but contemporarily allows operating with a certain degree of ease during the assembly step despite the steric hindrance.

In the variants shown, the blocking tooth 64 is substantially parallel to the stop element 66, but advantageously presents a circumferential extension inferior to said element 66.

The gun 1 further comprises a first 8' and a second 8" firing pin tip for a cartridge 10', 10", movable towards the cartridge chambers 12', 12" by means of a firing device operated by the trigger 4', 4".

As a result, following operation of the trigger, the firing tips 8', 8" shift in the direction of the cartridge to strike the fuse by means of the firing device.

In the variants shown, each firing pin comprises a firing pin body 52', 52" which defines the firing pin tip 8', 8" and an opposite firing pin head 50', 50"; this way the head is positioned proximally to the body 52' 52" while the tip, mechanically connected to the head, distally faces the cartridge chamber 12', 12".

Advantageously, the firing pin tips 8', 8", are housed so as to slide in seats 70 positioned proximally to the slide 20.

According to one embodiment each firing pin tip 8', 8" is constantly distanced from the cartridge chamber 12', 12" by means of an elastic component 68. For example, the elastic component 68 comprises a spring mounted coaxially to the firing pin so that the latter acts as a spring guide rod. Advantageously, the elastic component 68 is housed in the same slide seat 70.

According to a further variation, the firing device comprises a floating firing pin system.

According to different variants, the firing device comprises at least one hammer 14, hinged to the gripping portion 2, at least one firing pin body 52', 52" connected to the tips 8', 8", and/or at least one lever 22', 22" or at least one connection gear 24', 24" operatively associated to the trigger 4', 4", to transmit its operation to the firing pin tips 8', 8".

The aforesaid firing device acts on the firing pin tips 8', 8" to allow a substantially simultaneous advancement thereof.

Consequently, the gun of the present invention is suitable for avoiding the double firing action, in that the firing pin tips reach the cartridge chambers 12', 12" substantially in the same instant, so that the bullets of the cartridges contained therein are expelled from the muzzle 54 in a synchronous manner.

In other words, despite the presence of two barrels and of two cartridges, such gun is not subject to a double recoil thanks to the conformation of the firing device described below.

According to a first variant, the firing device comprises a hammer 14, common to both firing pin tips 8', 8" to move them towards the cartridge chambers 12', 12".

Preferably, the hammer 14 identifies a first 16' and a second 16" impact surface with the pair of firing pin heads 50', 50", where such surfaces 16', 16" are advantageously separated by an undercut (or lowered) area 18 for the at least partial housing of the slide 20 movable on the gripping portion 2.

As a result, such variant substantially corresponds to a gun with two hammers flanking each other, connected so as to be joined to each other by a connection arm 72. According to one embodiment, the two hammers and the connection arm 72 are made in one piece.

Advantageously, the hammer 14 is constantly influenced by at least one elastic element 76', 76" towards an abutment position with the firing pin.

As a result, in preparing to fire the gun, the hammer 14 must first be cocked from the abutment position to a loaded position, such that when the trigger is pressed, the elastic element 76', 76" returns the hammer to the abutment position.

In the variant shown, the elastic element 76', 76" comprises a helical spring, for example with a spring guide which crosses it longitudinally.

Advantageously, the gun 1 comprises a pair of elastic elements 76', 76", mounted parallel on the gripping portion, for example in a proximal portion of the same, advantageously along the grippable part 38.

According to a further embodiment, the firing device comprises a single firing pin body bearing the two firing pin tips 8', 8".

As a result, this variant envisages that the firing pin tips 8', 8" are joined to each other by virtue of a two tip firing pin.

This way, for example according to a variant with two separate hammers, even in the event that one of the hammers should reach the firing pin earlier than the other, the advancement of the two tips would in any case be guaranteed by the uniqueness of the firing pin for the two cartridge chambers.

According to a preferred embodiment, the firing device comprises a sole connection lever 22', 22", associated to two triggers 4', 4", so that the operation of either one of them generates the advancement of the firing pin tips 8', 8 and thereby firing.

According to a further preferred embodiment, the firing device comprises a sole connection gear 24', 24" which acts symmetrically, preferably at the connection lever 22', 22" and the hammer 14, for the two cartridge chambers 12', 12".

For example, the connection gear 24', 24" comprises a single connection tooth 74 which can be moved by the connection lever 22', 22" to release the single hammer 14, or a pair of hammers, towards the abutment position.

Merely by way of example, the transmission of the movement of the connection lever 22', 22" to the retention tooth 74 takes place by means of an eccentric system.

According to one advantageous embodiment, the firing device comprises a single trigger 4', 4" to operate a pair of hammers 14, connection levers 22', 22", connection gears 24', 24" and/or firing pin bodies 52', 52", to promote the movement of the firing pin tips 8',8".

According to a particularly reliable variation, the gun comprises each of the bilateral trigger, hammer, connection lever, connection gear and firing pin body couplings illustrated above.

Preferably, the gun comprises a first 34' and a second 34" recovery spring, acting on the gripping portion 2 and on the slide 20 to bring the latter back to the rest configuration when the pressure in the cartridge chambers 12', 12" is below a predefined value, for example corresponding to the atmospheric value.

In fact, after the firing pin tips have provoked firing of the fuse, the pressure in the cartridge chamber increases to the point of causing, on the one hand the distal expulsion of the bullets 58', 58" and on the other the proximal rearward movement of the slide towards the extraction configuration of the cartridge cases. In this step the rigidity of the recovery springs 34', 34" is selected so as to allow the opening of the cartridge chambers, so that such springs are compressed.

After the rearward movement of the slide is complete, since the cartridge chambers are open to the outside, the pressure of the latter rapidly falls to atmospheric values, so that the recovery springs 34', 34" distend to return the slide to the rest configuration.

According to a preferred embodiment, the recovery springs 34', 34" act on the guide bushes 26', 26", and in particular at the stop element 66, preferably with the interposition of a locking component 76', 76", In fact, according to one variation, the locking component 76', 76" distally defines at least one seat 78', 78" wherein the recovery springs can slide. Preferably, the gripping portion 2 defines a pair of seats 78', 78" flanking each other, each suitable for partially housing a recovery spring.

According to a further embodiment, the locking component 76', 76" is suitable for forming a shape coupling with the stop element 66.

For example, the locking element 66 defines a seat 80 to at least partially receive the locking component 76', 76".

According to a preferred variant, the locking component 76', 76" has a surface for abutment 82 with the stop element 66, shaped so as to prevent undesired rotations of the guide bushes 26', 26", for example subsequent to its assembly to the slide.

For example, the surface for abutment 82 comprises an axially projecting section 84 for engaging the seat 80, in such a way that the guide bush can be released from the slide only after having pushed the locking component 76', 76" in opposition to the force exerted by the recovery springs.

The present invention also relates to a two row magazine 36 suitable for being inserted in a double barrel gun, for example of the type described above, comprising a pair of reciprocally separate and parallel rows 40', 40", each delimiting a compartment 42', 42" to slidingly house a plurality of cartridges 10', 10", and a magazine bottom 44 connected to the rows 40', 40" to join them to each other; the connection of at least one 40'; 40" of such rows to the bottom of the magazine 44 is releasable.

The present invention lastly relates to a gun 1 comprising a gripping portion 2, a first 6' and a second 6" barrel, connected to the gripping portion 2 and flanking each other, wherein an end portion of each barrel 6', 6" defines a chamber 12', 12" for a cartridge 10',10". Such gun 1 comprises a slide 20 mounted on the barrels 6', 6" in a translatable manner between a rest configuration and an extraction configuration, wherein the slide 20 allows the exit of a cartridge case 28', 28" from at least one of the cartridge chambers 12', 12", and wherein the slide 20 is mounted on the barrels 6', 6" by means of guide bushes 26', 26" reciprocally counter-rotatable so as to be attached to the slide 20.

Innovatively, the gun which the present invention relates to is suitable for firing two bullets from barrels flanking each other in a substantially simultaneous manner, such firing action occurring substantially in the absence of a double action.

Advantageously, the coupling method of the firing device is easy to construct and is extremely resistant to wear, since the synchronisation of the shots fired is guaranteed even following intensive use of the firearm.

Advantageously, despite the increased ballistic efficiency, the gun which the present invention relates to is designed to present an extremely limited transversal dimension.

Advantageously, the gun which the present invention relates to has a superior stopping power to traditional guns, and further permits a desired fire power to be achieved at a certain distance from the firearm.

Advantageously, the gun which the present invention relates to permits an extremely rapid exit of the gases generated by the explosion of the fuse, thanks to the increased cross-section for their transit.

Advantageously, the gun which the present invention relates to presents an extremely simple and reliable assembly method, so that the couplings between the various components remain accurate even after numerous firing cycles or servicing.

Advantageously, the recovery springs used in the present gun exercise a dual function as components for the repositioning of the slide, and as means suitable for preventing the accidental dismantling of the firearm.

Advantageously, the gun which the present invention relates to is extremely reliable in that, should one of the two fuses be defective or fail to detonate, the movement of the slide would be such as to allow the extraction of a cartridge case and of the cartridge which has failed to fire; this way at the subsequent firing cycle, the present gun is once again able to function normally.

Advantageously, the gun which the present invention relates to is suitable for being used regardless by right-hand or left-hand users, given the rational arrangement of the triggers.

Advantageously, the gun which the present invention relates to has been specially designed to resist the stresses of a double fuse and the increased rearward force of the slide; such greater structural resistance differentiates the present gun from traditional double barrelled guns, designed to withstand solely one detonation per firing cycle.

A person skilled in the art may make variations to the aforementioned embodiments of the gun and of the magazine or replace elements with others functionally equivalent so as to satisfy specific requirements.

Such variations are also contained within the scope of protection as defined by the following claims.

Moreover, each of the variants described as belonging to a possible embodiment may be performed independently of the other variants described.

The invention claimed is:

1. A gun comprising:

a gripping portion;

a first and a second barrel, connected to the gripping portion and flanking each other, wherein an end portion of each barrel defines a chamber for a cartridge;

a slide mounted on the barrels in a translatable manner between a rest configuration and an extraction configuration, wherein the slide allows the exit of a cartridge case from at least one of the cartridge chambers;

wherein the slide is mounted on the barrels by means of reciprocally counter-rotatable guide bushes so as to be fixed to the slide.

2. The gun according to claim 1, further comprising:

the gripping portion and at least one trigger mounted in a movable manner to the gripping portion; and a first and a second firing pin tip for the cartridge, movable towards the cartridge chambers of a firing device operated by the trigger;

wherein the firing device acts on the firing pin tips to allow a substantially simultaneous advancement thereof.

3. The gun according to claim 2, wherein the firing device comprises a hammer, hinged to the gripping portion, common to said firing pin tips.

4. The gun according to claim 3, wherein the hammer identifies a first and a second impact surface with a pair of firing pin heads, mechanically connected to the firing pin tips, said surfaces being separated by an undercut area to at least partially house a slide associated to the gripping portion.

5. The gun according to claim 2, wherein the firing device comprises at least one lever or connection gear operatively associated to the trigger, to transmit its operation to the firing pin tips.

6. The gun according to claim 2, wherein the firing device comprises a single trigger to operate a pair of hammers, connection levers, connection gears and/or firing pin bodies, to promote the movement of the firing pin tips.

7. The gun according to claim 1, wherein the barrels are of a different calibre to each other.

8. The gun according to claim 1, wherein the guide bushes at least partially house said barrels.

9. The gun according to claim 1, wherein the slide identifies a pair of transit apertures, opposite each other, of a sufficient cross-section to expel the cartridge cases from the cartridge chambers.

10. The gun according to claim 9 wherein, when the slide is in the extraction configuration, the transit apertures communicate with each other forming a passage which extends through the thickness of the gun.

11. The gun according to claim 1, further comprising a first and a second recovery spring, acting on the gripping portion and on the slide to bring the slide back to the rest configuration when pressure in the cartridge chambers is below a predefined value.

12. The gun according to claim 8, wherein the guide bushes are reciprocally counter-rotatable so as to be attached to the slide with a bayonet coupling.

13. The gun according to claim 1, comprising a two row magazine engaged in a grippable part of the gripping portion.

14. The gun according to claim 13, wherein the magazine comprises:

a pair of reciprocally separate and parallel rows, each delimiting a compartment to slidingly house a plurality of cartridges; and a magazine bottom connected to the rows to join them to each other.

15. The gun according to claim 14, wherein the connection of at least one of said rows to the bottom of the magazine is releasable.

* * * * *